US006511126B1

(12) United States Patent
McAdams

(10) Patent No.: US 6,511,126 B1
(45) Date of Patent: Jan. 28, 2003

(54) LAWN FURNITURE ATTACHMENT

(76) Inventor: John C. McAdams, 4034 S. Scoville Ave., Stickney, IL (US) 60402

( * ) Notice: Subject to any disclaimer, the term of this patent is extended or adjusted under 35 U.S.C. 154(b) by 0 days.

(21) Appl. No.: 10/127,233

(22) Filed: Apr. 18, 2002

(51) Int. Cl.[7] ..... A47C 31/00

(52) U.S. Cl. ..... 297/217.1; 297/219.1; 297/423.4; 297/411.23; 297/397

(58) Field of Search ..... 297/463.1, 463.2, 297/188.01, 188.02, 217.1, 219.1, 392, 397, 391, 411.2, 411.23, 411.24, 411.25, 423.4; 40/320; 116/173; 5/636, 646, 648, 653, 658

(56) References Cited

U.S. PATENT DOCUMENTS 1,665,535 A * 4/1928 Davis
3,311,410 A * 3/1967 Hill
5,048,892 A 9/1991 Ledbetter ..... 297/219
5,207,481 A * 5/1993 Ayala, Jr. et al.
5,700,053 A * 12/1997 Downing
5,829,832 A 11/1998 Molee ..... 297/397
5,904,406 A 5/1999 Stewart ..... 297/397
5,934,754 A 8/1999 Raffa ..... 297/392
6,070,347 A * 6/2000 Hergott
6,086,152 A * 7/2000 Zeller
6,095,172 A 8/2000 Trapp ..... 135/96

* cited by examiner

*Primary Examiner*—Milton Nelson, Jr.

(57) ABSTRACT

A lawn furniture attachment for providing additional comfort and protection to an existing piece of lawn furniture while including a unique information transferring apparatus. The lawn furniture attachment includes a cushion with an extendable flagging mechanism stored internal to the cushion. The cushion is attachable to the tubular frame section of most current traditional pieces of lawn furniture. The cushion can be attached as a headrest, armrest or most preferably a footrest. The flagging mechanism can be extracted from inside the cushion and placed in a vertical position. The flagging mechanism can then be extended vertically to visually attract the attention of others.

20 Claims, 7 Drawing Sheets

LAWN FURNITURE ATTACHMENT

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to lawn furniture attachments and more specifically it relates to a lawn furniture attachment for providing additional comfort and protection to an existing piece of lawn furniture while including a unique information transferring apparatus.

2. Description of the Related Art

Lawn furniture has been in use for years. Typically, lawn furniture is made with a frame constructed from aluminum or plastic and covered with some type of material or plastic. Lawn furniture comes in a variety of configurations and sizes. Sitting or reclining on currently produced lawn furniture can be uncomfortable because existing systems do not traditionally include additional padding on the rigid frame sections.

Additionally, existing lawn furniture does not provide a mechanism to pass on information to others. It is customary at resorts and other business establishments to place lawn furniture around a pool or on the beach for the use of their clientele. Customarily the resort will have a bar for providing beverages to the clientele. Currently, the business establishment or resort's wait staff must question the clientele to determine if the clientele requires any service.

Examples of patented devices which are related to the present invention include U.S. Pat. No. 5,829,832 to Molee; U.S. Pat. No. 5,904,406 to Stewart; U.S. Pat. No. 5,934,754 to Raffa; U.S. Pat. No. 5,048,892 to Ledbetter; and U.S. Pat. No. 6,095,172 to Trapp.

While these devices may be suitable for the particular purpose to which they address, they are not as suitable for providing additional comfort and protection to an existing piece of lawn furniture while including a unique information transferring, apparatus. The prior art systems are primarily limited to providing additional padding, for the head and do not normally provide cushioning for the legs. In addition, the prior art systems do not provide an independent means of attracting the attention of a resort or other business establishment's wait staff so that service can be rendered.

In these respects, the lawn furniture attachment according to the present invention substantially departs from the conventional concepts and designs of the prior art, and in so doing provides an apparatus primarily developed for the purpose of providing additional comfort and protection to an existing piece of lawn furniture while including a unique information transferring apparatus.

BRIEF SUMMARY OF THE INVENTION

In view of the foregoing disadvantages inherent in the known types of lawn furniture attachments now present in the prior art, the present invention provides a new lawn furniture attachment construction wherein the same can be utilized for providing additional comfort and protection to an existing piece of lawn furniture while including a unique information transferring apparatus.

The general purpose of the present invention, which will be described subsequently in greater detail, is to provide a new lawn furniture attachment that has many of the advantages of the lawn furniture attachments mentioned heretofore and many novel features that result in a new lawn furniture attachment which is riot anticipated, rendered obvious, suggested, or even implied by any of the prior art lawn furniture attachments, either alone or in any combination thereof.

To attain this, the present invention generally comprises a cushion with, an extendable flagging mechanism stored internal to the cushion. The cushion is attachable to the tubular framing support of most current traditional pieces of lawn furniture. The cushion can be attached as a headrest, armrest or most preferably a footrest. The flagging mechanism can be extracted from inside the cushion and placed in a vertical position. The flagging mechanism can then be extended vertically to visually attract the attention of others.

There has thus been outlined, rather broadly, the more important features of the, invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a lawn furniture attachment that will overcome the shortcomings of the prior art devices.

A second object is to provide a lawn furniture attachment for providing additional comfort and protection to an existing piece of lawn furniture while including a unique information transferring apparatus.

Another object is to provide a lawn furniture attachment that can provide immediate point of sales for business establishments and resorts by the utilization of a flagging mechanism.

A further object is to provide a lawn furniture attachment that could be used as a promotional device by resorts or other business establishments.

Another object is to provide a lawn furniture attachment that may include flags conveying various different messages.

A further object is to provide a lawn furniture attachment that provides a medium for additional advertising on the cushion.

Another object is to provide a lawn furniture attachment that is portable and can be used on various types of lawn furniture.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
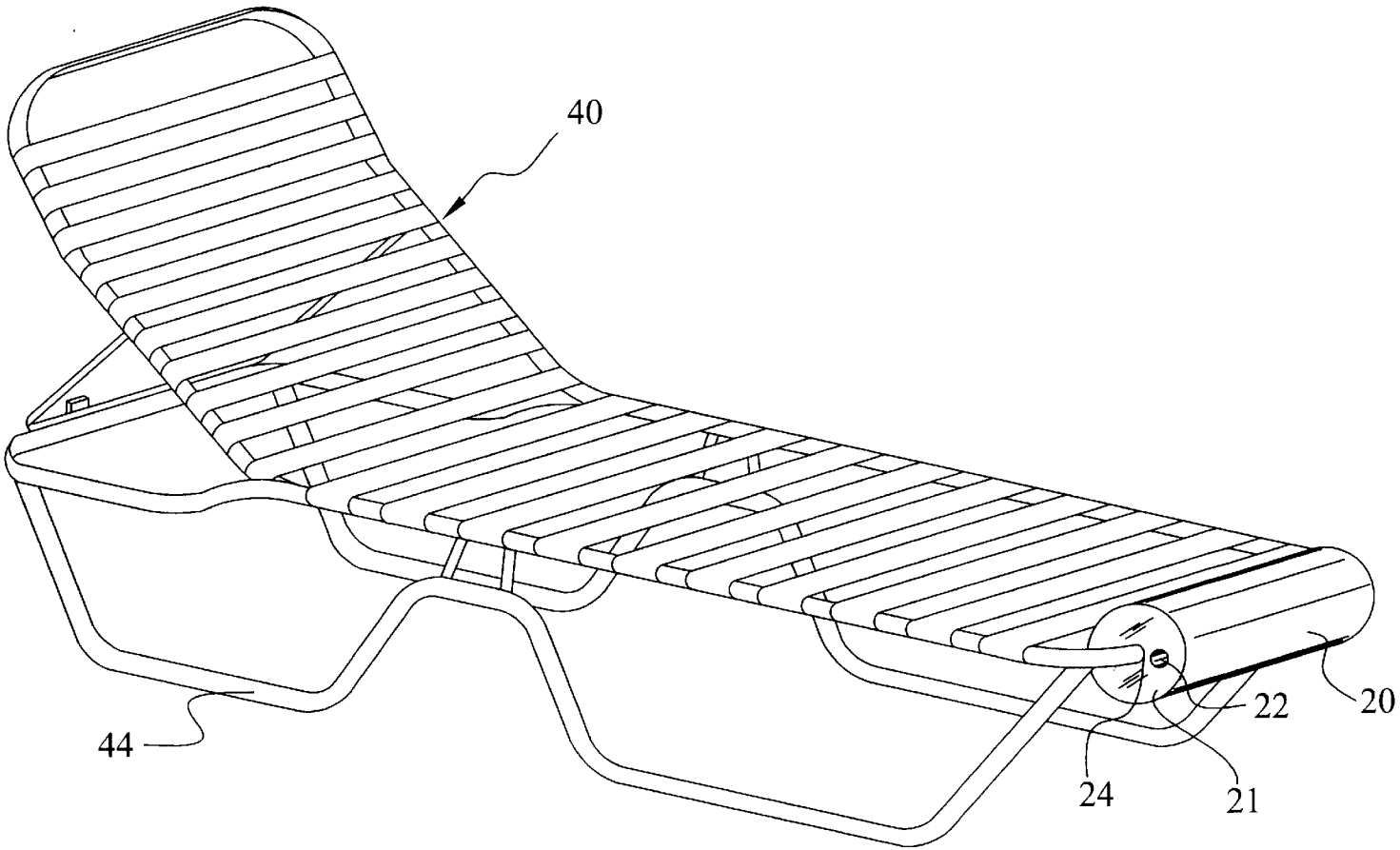
FIG. 1 is an upper perspective view of the present invention attached to a piece of lawn furniture.
Figure 2:
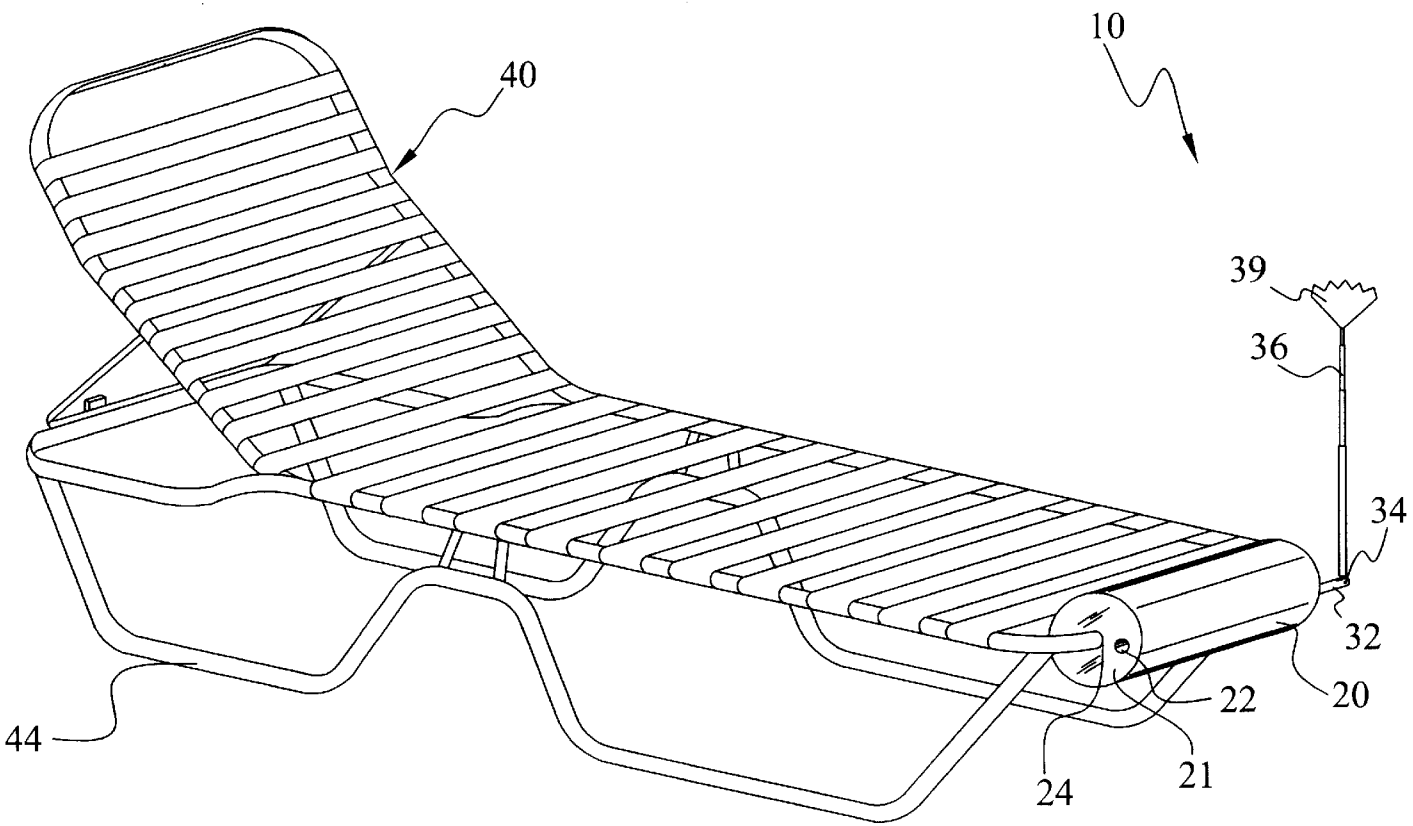
FIG. 2 is an upper perspective view of the present invention attached to a piece of lawn furniture with the flagging mechanism extended.

Turning now descriptively to the drawings, in which similar reference characters denote similar elements throughout the several views, FIGS. 1 through 7 illustrate a lawn furniture attachment 10, which comprises a cushion 20 having a main bore 24 with a slot 28 from the outer periphery 26 to the main bore 24 traveling the longitudinal length of the cushion 20. A secondary bore 22, preferably running parallel to the main bore 24, also travels down the longitudinal length of the cushion 20. Insertable into the secondary bore 22 is a flagging mechanism 30. The flagging mechanism 30 can be withdrawn from the hollow core 22 and pivotally adjusted to allow the second rod 36 of the flagging mechanism 30 to be extended in a vertical direction. Affixed to the end of the second rod 36 is a flag 39.

Figure 5:
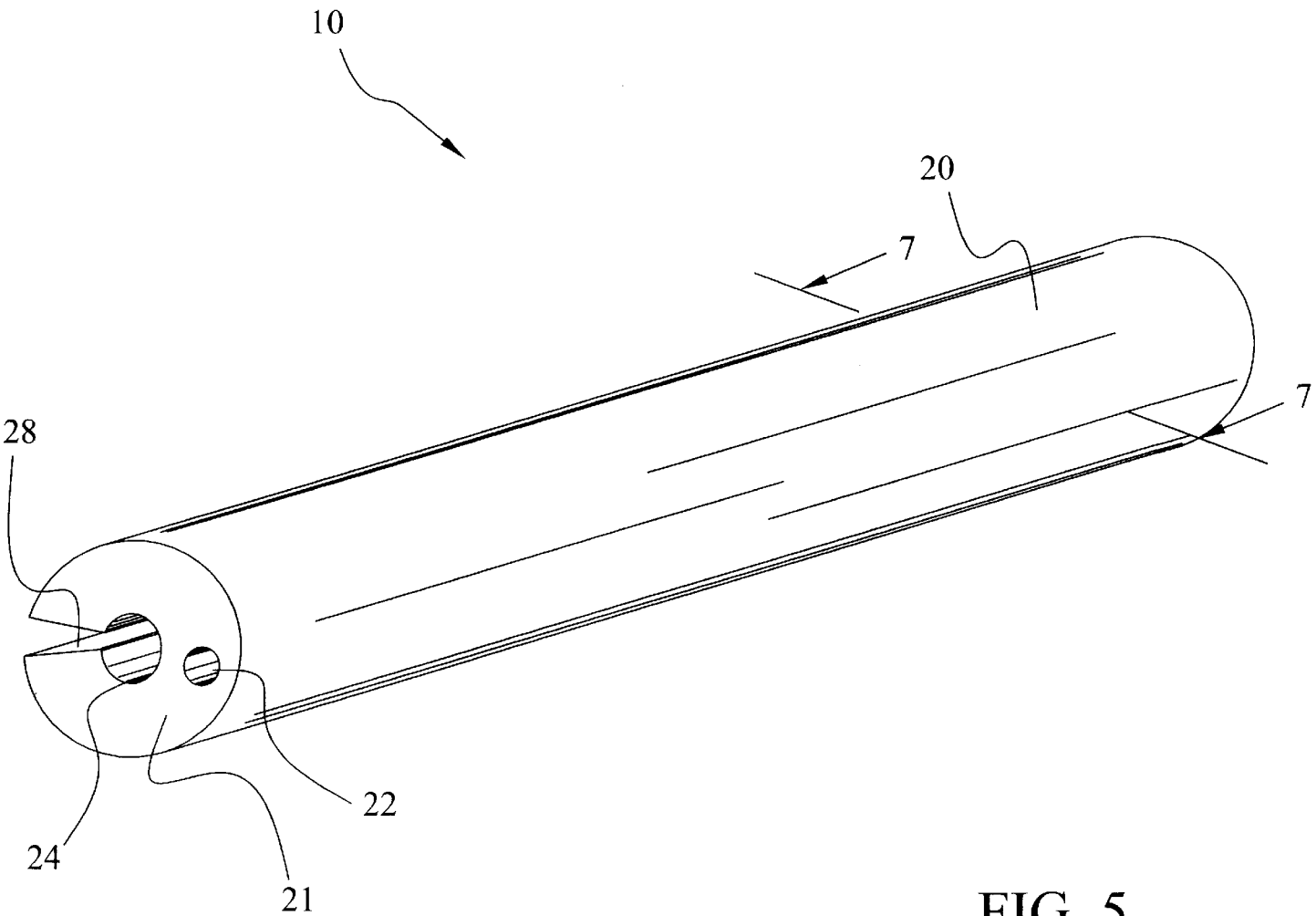
FIG. 5 is a side view of the cushion.
Figure 6:
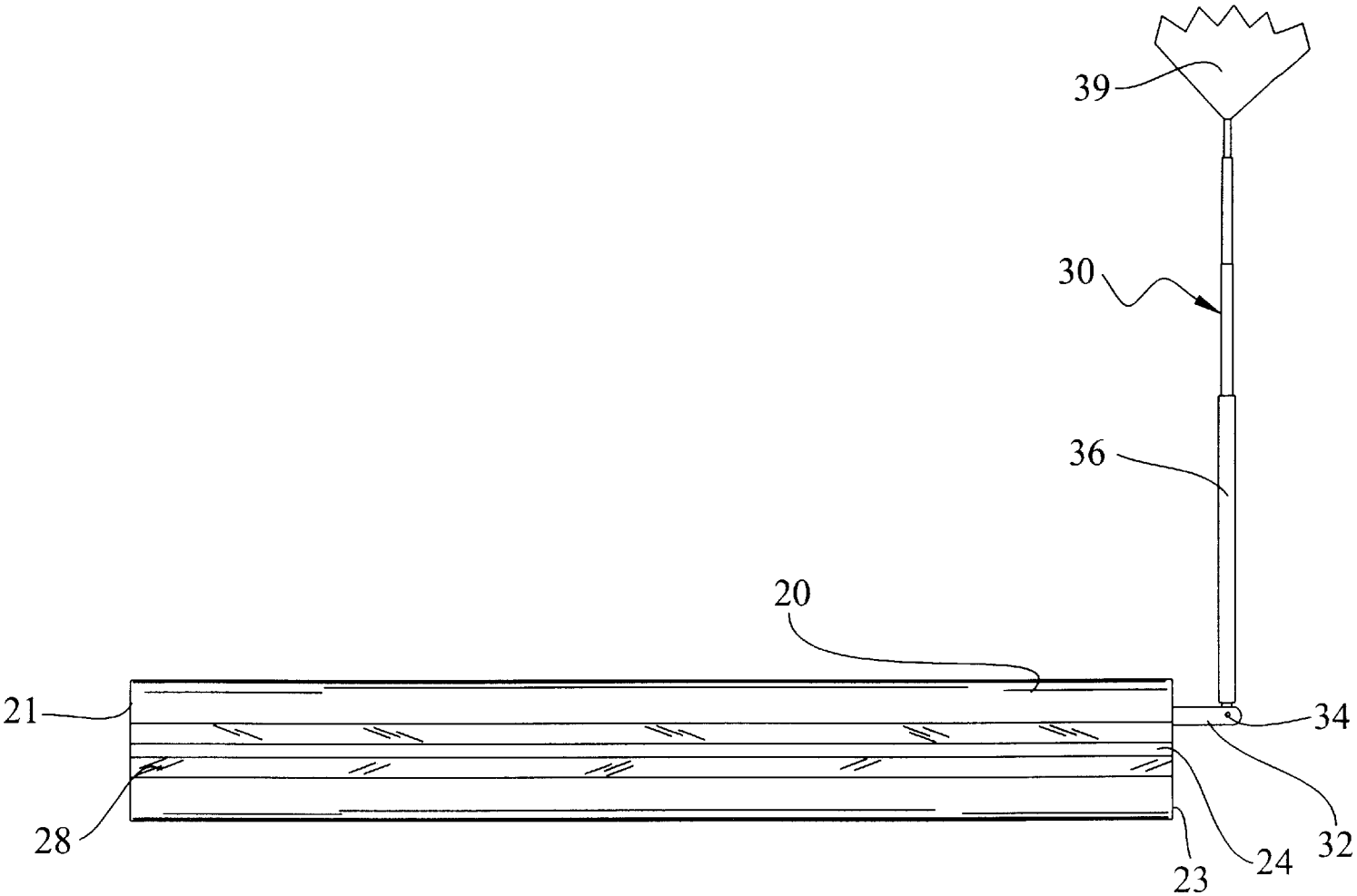
FIG. 6 is a front view of the present invention with the flagging mechanism extended.
Figure 7:
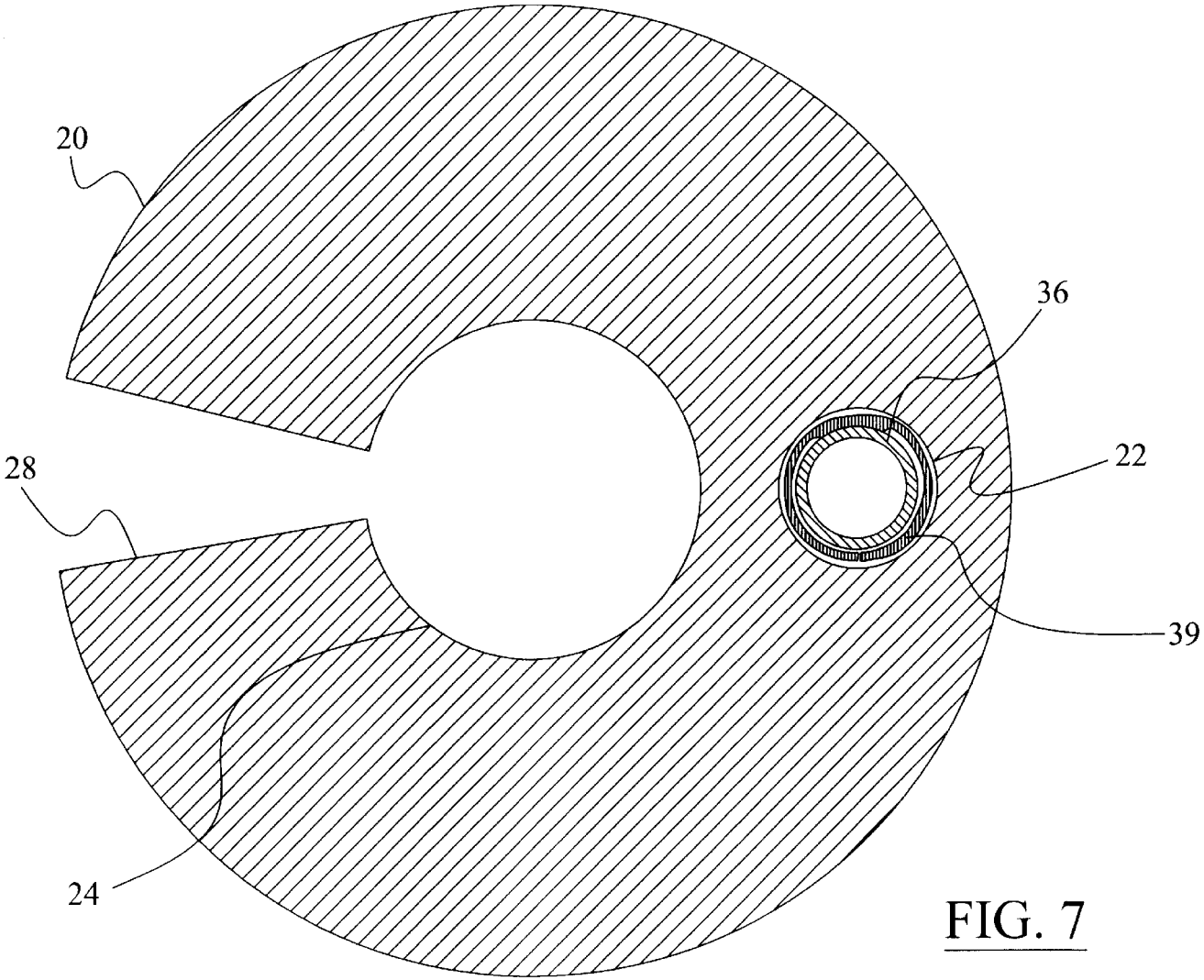
FIG. 7 is a sectional view of the present invention along line 7—7 of FIG. 5.

As best seen in FIG. 5, the cushion 20 is preferably constructed in a cylindrical solid form. Perpendicular to the longitudinal axis, the cushion 20 has a first end 21 and a second end 23. The cushion 20 may be constructed from foam rubber, closed cell polyethylene foam or some other suitable material. Preferably the outer periphery 26 of the cushion 20 has a surface capable of accepting various printed or imbedded designs.

A main bore 24 runs longitudinally through the cushion 20 from the first end 21 to the second end 23 along the longitudinal axis. A slot 28 connects the outer periphery 26 to the main bore 24 and travels longitudinally from the first end 21 to the second end 23. The diameter of the main bore 24 is of such a dimension that it will fit over the framing support 44 of most commercially available lawn furniture.

Figure 3:
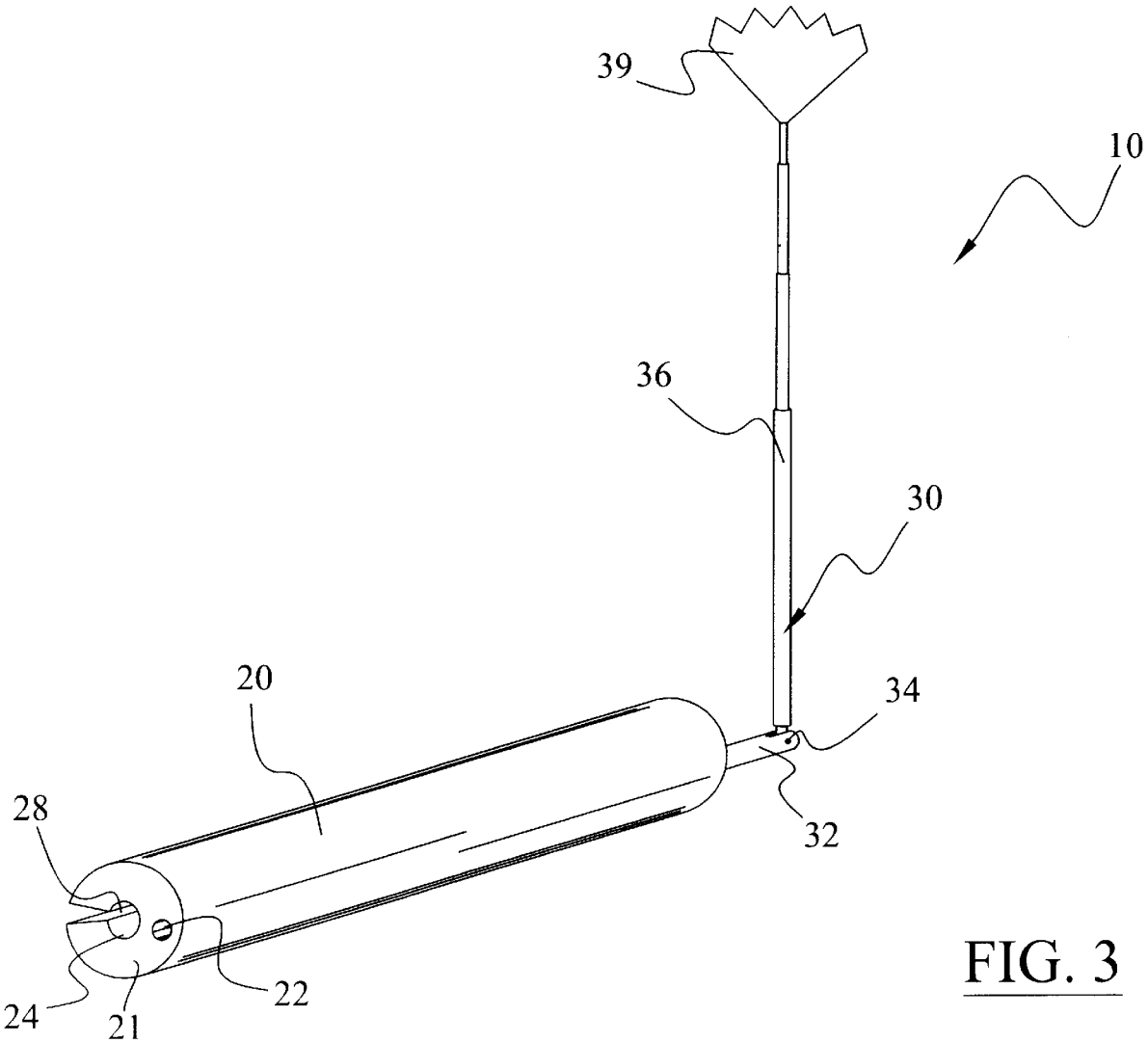
FIG. 3 is a side view of the present invention with the flagging mechanism extended.
Figure 4:
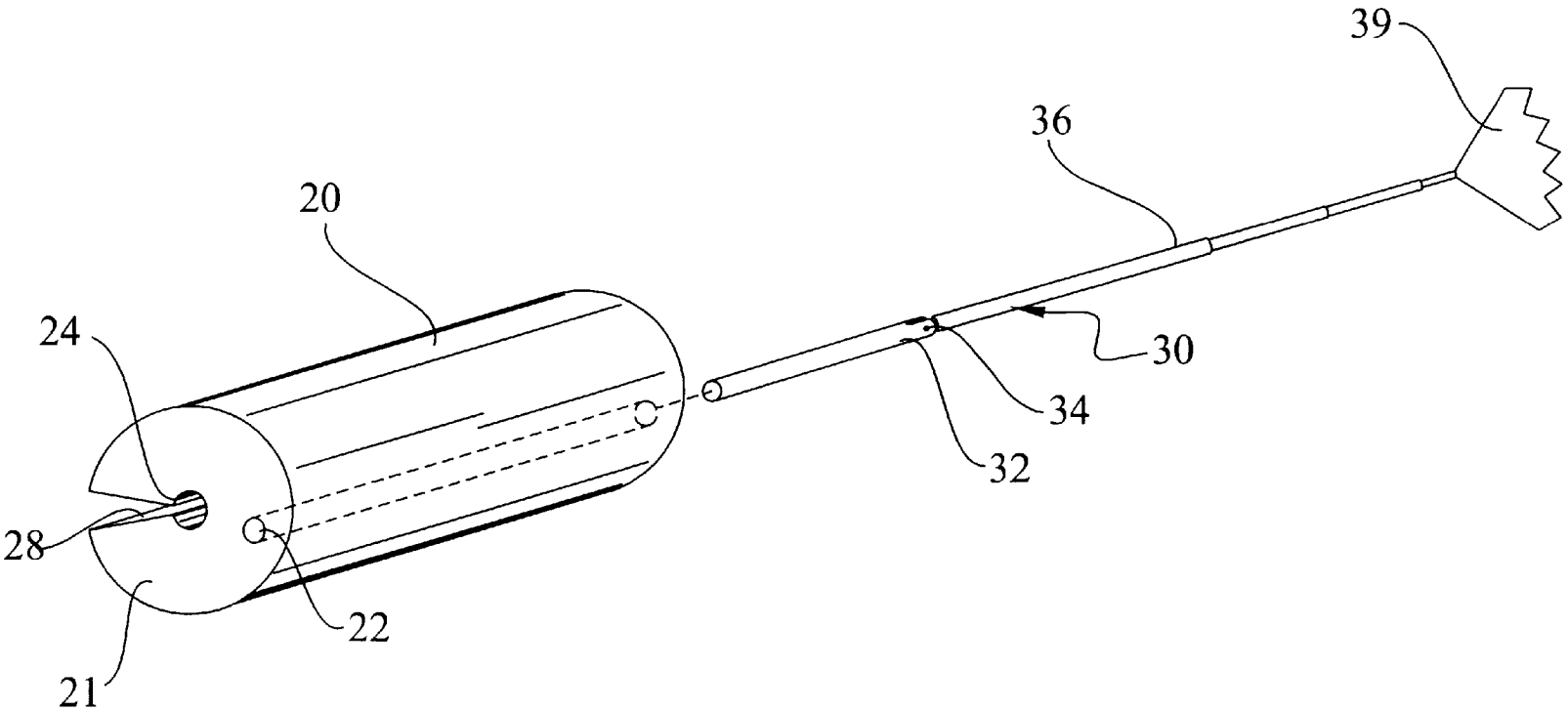
FIG. 4 is an exploded side view of the cushion with rods and flag extracted.

The secondary bore 22 extends through the cushion 20. The secondary bore 22 preferably runs parallel to the main bore 24 and longitudinally from the second end 23 towards the first end 21. As seen in FIGS. 3 and 4, the secondary bore 22 may run entirely from the second end 23 to the first end 21, but need only run the length necessary to internally accept the flagging mechanism 30. The diameter of the secondary bore 22 may be such that it will internally accept the flagging mechanism 30.

As best seen in FIGS. 3 and 4, the flagging mechanism 30 is preferably comprised of a first rod 32 having a first end and a second end. The second end of the first rod 32 is preferably connected to a swivel 34 or similar type of pivoting attachment. The flagging mechanism 30 preferably has a second rod 36 having a first end and a second end. The first end of the second rod 36 is attached to the swivel 34 opposite the first rod 32. The second rod 36 is preferably extendable either telescopically or by some other similar means. Either one or both of the rods 32, 36 may be manufactured using flexible material. Alternatively, the rods 32, 36 may be non-movably connected to one another.

A flag 39 is preferably attached to the second end of the second rod 36. The flag 39 is constructed in such a manner to facilitate the flag 39 being insertable into the second end 26 of the secondary bore 22. The flag 39 may have accordion folds to facilitate insertion in the second end 26 of the secondary bore 22. The flag 39 may be shaped in an inverted triangle and may include accordion folds. However, it can be appreciated by one skilled in the art that other embodiments of the present invention may include flags 39 of various shapes, sizes and colors. The flag 39 may be made from a flexible material such as plastic or other suitable material and with a surface to allow printed or imbedded designs to be applied thereto.

In use, the slot 28 is pried open and positioned about the framing support 44 of a piece of lawn furniture 40. The lawn furniture attachment 10 is forced over the framing support 44 until the main bore 24 envelops the framing support 44 as seen in FIG. 1. The lawn furniture attachment 10 may now be used to provide added comfort and support to the legs, head or arms of an individual using the lawn furniture 40 depending on where the lawn furniture attachment 10 is attached.

To transfer information to others, such as requesting service from a resort's wait staff, the flag 39 and second rod 36 are drawn out from the interior of the secondary bore 22. By manipulating the second rod 36 in relation to the swivel 34, the second rod 36 is placed in the vertical position. The second rod 36 is then expanded. In the vertical position the flag 39 expands transferring its message.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lawn furniture attachment, comprising:

a cushion having a first end, a second end, and a longitudinal axis;

a main bore extending through said cushion from said first end to said second end;

a slot extending into said cushion and connected to said main bore;

a secondary bore extending into said first end of said cushion; and a flagging mechanism slidably insertable into said secondary bore.

2. The lawn furniture attachment of claim 1, wherein said cushion is made from a lightweight flexible material.

3. The lawn furniture attachment of claim 1, wherein an outer periphery of said cushion includes a marketing indicia.

4. The lawn furniture attachment of claim 1, wherein said slot is tapered.

5. The lawn furniture attachment of claim 1, wherein said flagging mechanism comprises:

a first rod; and a flag attached to said first rod.

6. The lawn furniture attachment of claim 5, wherein said first rod is made from a flexible material.

7. The lawn furniture attachment of claim 1, wherein said flagging mechanism comprises:

a first rod;

a second rod pivotally attached to said first rod; and a flag attached to said second rod.

8. The lawn furniture attachment of claim 7, wherein said second rod is telescopic.

9. The lawn furniture attachment of claim 7, wherein said flag has accordion folds to facilitate insertion into said secondary bore.

10. A lawn furniture attachment, comprising:

a cushion having a first end, a second end, and a longitudinal axis;

a main bore extending through said cushion from said first end to said second end;

a slot extending into said cushion and connected to said main bore;

a secondary bore extending through said cushion from said first end to said second end; and a flagging mechanism slidably insertable into said secondary bore.

11. The lawn furniture attachment of claim 10, wherein said cushion is made from a lightweight flexible material.

12. The lawn furniture attachment of claim 10, wherein an outer periphery of said cushion includes a marketing indicia.

13. The lawn furniture attachment of claim 10, wherein said slot is tapered.

14. The lawn furniture attachment of claim 10, wherein said flagging mechanism comprises:

a first rod; and a flag attached to said first rod.

15. The lawn furniture attachment of claim 14, wherein said first rod is made from a flexible material.

16. The lawn furniture attachment of claim 10, wherein said flagging mechanism comprises:

a first rod;

a second rod pivotally attached to said first rod; and a flag attached to said second rod.

17. The lawn furniture attachment of claim 16, wherein said second rod is telescopic.

18. The lawn furniture attachment of claim 16, wherein said flag has accordion folds to facilitate insertion into said secondary bore.

19. A method of conveying information to individuals, said method comprising the following steps:

(a) providing a lawn furniture attachment having a cushion having a first end, a second end, and a longitudinal axis; a main bore extending through said cushion from said first end to said second end; a slot extending into said cushion and connected to said main bore; a secondary bore extending into said first end of said cushion; and a flagging mechanism having a first rod, a second rod and a flag slidably inserted within said secondary bore;

(b) removing said flagging mechanism out of said secondary bore; and (c) extending said flagging mechanism; and (d) inserting said first rod within said secondary bore.

20. A method of conveying information to individuals, said method comprising the following steps:

(a) providing a lawn furniture attachment having a cushion having a first end, a second end, and a longitudinal axis; a main bore extending through said cushion from said first end to said second end; a slot extending into said cushion and connected to said main bore; a secondary bore extending into said first end of said cushion; and a mechanism having a first rod, a second rod and a flag inserted within said secondary bore;

(b) removing said second rod and said flag out of said secondary bore; and (c) leaving said first rod within said secondary bore; and (c) pivoting said second rod and said flag vertically.

* * * * *